United States Patent [19]

Starr

[11] 4,302,886

[45] Dec. 1, 1981

[54] GYROSCOPIC DIRECTIONAL SURVEYING INSTRUMENT

[75] Inventor: George N. Starr, Memphis, Tenn.

[73] Assignee: Robert L. Fournet, Lafayette, La.

[21] Appl. No.: 88,959

[22] Filed: Oct. 29, 1979

[51] Int. Cl.[3] ..... E21B 47/022

[52] U.S. Cl. ..... 33/312; 62/259.2; 73/431

[58] Field of Search ..... 33/304, 312, 302, 313, 33/310, 309, 350; 62/259 R, 259 A; 250/256, 254, 268; 73/431

[56] References Cited

U.S. PATENT DOCUMENTS

| | | | |
|---|---|---|---|
| 2,187,028 | 1/1940 | Hendrickson . | |
| 2,313,168 | 3/1943 | Opocensky | 33/350 |
| 2,711,084 | 6/1955 | Bergan | 73/431 X |
| 3,079,696 | 3/1963 | Van Rooyen . | |
| 3,384,750 | 5/1968 | Owen | 33/312 |
| 3,488,970 | 1/1970 | Hallenburg | 62/259 A |
| 3,845,569 | 11/1974 | Otte et al. | 33/312 |
| 4,096,752 | 6/1978 | Tonnelli | 73/431 |

FOREIGN PATENT DOCUMENTS

| | | | |
|---|---|---|---|
| 1412371 | 8/1965 | France | 33/350 |

*Primary Examiner*—William D. Martin, Jr.
*Attorney, Agent, or Firm*—Walker & McKenzie

[57] ABSTRACT

Apparatus used for the directional surveying of deep wells, i.e., 20,000–25,000 feet (6,096 meters–7,620 meters), and which is specifically identified as a gyroscopic directional surveying instrument having a high pressure and a high temperature capability, e.g., 24,000 pounds per square inch (1,632.65 atmospheres) and 450° F. (232.22° C.). While in its fully assembled configuration, the apparatus may be described as being exceptionally long (or at times unwieldy), e.g., 12–16 feet long (3.66 meters–4.88 meters), it is quite remarkable that it does not exceed three inches (76.2 millimeters) in diameter. Therefore, it may readily be lowered into the small diameter steel casing normally defining the walls of these deep wells. In view of its cumbersomeness, it is significant to note that the apparatus may readily be broken-down into upper and lower sub-assemblies when being transported to or from the well site. Moreover, structure is included for individually protecting each sub-assembly from the adverse affects of the extreme pressure and temperature. Therewith, the feasibility of "on site" mating and demating of these sub-assemblies is achieved. Equally significant is that structure is included which readily enables the required physical access—at the "on site" location—to the internally disposed gyrocompass, inclinometer, and camera systems, i.e., for the purpose of accomplishing certain initial preparations and/or calibration procedures.

6 Claims, 20 Drawing Figures

GYROSCOPIC DIRECTIONAL SURVEYING INSTRUMENT

FIELD OF THE INVENTION

This invention relates to the field of directional surveying instruments or to instruments used in determining the path which is established by a deep well and is particularly directed toward that type which depends upon an electrically driven gyrocompass as one of the instruments incorporated therewith.

When deep holes are drilled into the earth's surface, the path taken by the drill bit is rarely a straight line. This may occur because of variations in the structure being penetrated or simply because of limitations in the equipment or techniques being used. In the case of oil wells, the direction of the hole may, for many reasons, be deliberately changed from vertical. In any event, it is rare that either the bottom or indeed the greater portion of the hole lies directly beneath the wellhead.

It is particularly important in oil wells to determine carefully not only the location of the bottom and/or a particular portion of the hole (this would obviously be important from a legal standpoint) but also the entire path the drill bit takes as the well progresses. This kind of information would be vital in the event of a blowout of the well if, as a means of controlling the blowout, it became necessary to drill a relief well to the immediate vicinity of some point in the existing well.

To determine the path of the hole, there are two systems in general use today, both of which are included in what has come to be known as "directional surveying."

In the first, a magnetic compass in conjunction with an inclinometer comprises the instrumentation. The equipment is arranged so that it may be lowered into the bore hole to the desired depth at which point the inclination and the direction of the inclination are measured. Acquisition of this data is usually by means of a photograph of the compass and inclinometer taken by a camera incorporated into the instrument package. If these readings are taken at appropriate depth intervals (on the order of 100 feet or so), the path taken by the drill bit can be extrapolated by mathematical means.

In the second system, the magnetic compass is replaced by an electrically driven gyrocompass. Survey and calculating procedures are essentially the same as described above. The use of the gyrocompass does, however, permit directional surveys to be made where various disturbances of the earth's magnetic field render the magnetic compass useless.

It should be obvious from the above that the instruments described must be contained in some sort of protective enclosure capable of resisting whatever chemical, pressure, or temperature factors may be present and yet compromising in no way their proper functioning.

DESCRIPTION OF THE PRIOR ART

Heretofore, electrically driven gyrocompass directional surveying instruments have been limited for use in those wells which are not considered deep wells by today's standards. Therefore, the industry has by necessity been totally dependent upon the use of the magnetic compass directional surveying instruments when surveying deep wells. In view of the above, it is deemed prudent to discuss, at length, certain characteristics of the prior art.

Accordingly, the instrument package and protective enclosure generally in use for previous gyrocompasses is shown in FIG. 1 of the drawings. A gyrocompass 501 has fitted on its lower end an electrical connector and an index pin arranged so that it is connected both mechanically and electrically to a switch sub 502. The switch sub 502, on its upper face, has the configuration and construction necessary to interface properly with the gyrocompass 501.

The switch sub 502 and its lower end are suitably arranged so that an electrical current from a gyro battery pack 503 may be fed through it to the gyrocompass 501, i.e., for powering the spin motor.

The switch sub 502 also has in it a precisely located transverse tapered hole, as at 504, and on its outer surface a groove, as at 505, of particular cross-section. The purpose for both of these features will be explained later.

To complete the lower portion of the package an outer protective tubular enclosure, as at 506, is incorporated. The ends of this enclosure contain female threads and a packing means to prevent entry of fluids. The lower end of the switch sub 502 and the upper end of a bottom sub, as at 507, incorporate the necessary thread and gland configuration to interface with the lower enclosure 506.

The upper section of the package includes the gyrocompass 501; and inclinometer, as at 508; a camera, as at 509; and the camera power source or battery pack, as at 510. The camera battery pack 510 supplies power to the camera 509 both for illumination and for film advance purposes. The inclinometer 508 is of tubular configuration and is transparent at both ends so that the camera can simultaneously photograph both the angle sensing device and the gyrocompass card, i.e., the card is not shown but is fitted to the upper end of the gyrocompass 501 in a manner well known to those skilled in the art.

The package also includes an upper protective enclosure, as at 511, and a top sub member 512 which are arranged similar to their counterparts 506 and 507 on the lower section and function in like fashion.

Referring now to FIG. 1, particularly the tapered hole 504 and the groove 505 which are used in the following fashion:

In preparing the instrument package for lowering into a borehole B (see FIG. 2) it is necessary to calibrate accurately the gyrocompass 501 and other portions of the equipment. To help accomplish this task, a tripod stand, as at 513, is used to support the package 514 directly over the well head as shown in FIG. 2 of the drawings. An upper plate 515 of the stand 513 is shown in isometric view in FIG. 4 of the drawings. This plate 515 incorporates a chamferred center hole, as at 516, surrounded by a protractor scale 517. This plate 515 also has machined into it a slot, as at 518, which allows (see FIG. 1) a grooved portion 505 of the switch sub 502 to engage the plate 515 in such a manner as to establish the center line of the instrument package 514 coaxial with that of the top plate 515 with considerable accuracy. This arrangement also allows the instrument package 514 to be moved rotatably through angles which can be measured with great accuracy by observing the position of the switch sub 502 relative to the protractor scale 517 by means of suitable index marks located on the switch sub 502.

The other device necessary to the calibration of the gyrocompass is a telescope type transit instrument, as at 519, and as shown in FIG. 6 of the drawings. The transit 519 is mounted on a pin as at 520, which has a tapered portion, as at 521, on one end thereof. This tapered portion 521 is arranged to matingly fit into the tapered hole 504 in the switch sub 502. With this arrangement, it can be seen that by sighting a known land surveyor's benchmark with the transit 519, directions necessary to the calibration of the gyrocompass 501 can be established with requisite accuracy.

Further details regarding calibration procedures would add little to the background necessary for the disclosure of the invention except for the manner in which access is obtained during such procedures. This will be outlined in the following paragraph and is germane to the disclosure.

The usual procedure used in setting the gyrocompass surveying equipment would be more or less as follows:

Referring to FIG. 3 of the drawings, the gyro battery pack together with its protective enclosure (shown together and as characterized by the numeral 522) would be assembled to the switch sub 502 and this assembly placed in the tripod stand 513 over the well head or bore B. The gyrocompass 501 would be placed in position and the gyrocompass calibration described earlier would then be carried out.

Referring now to FIG. 5 of the drawings, it will be seen that added now to the above components are the inclinometer 508, the camera 509, and the battery pack 510. Shown also but not in assembled position is the upper protective enclosure 511 and the top sub 512 both of which are now suspended from a cable and winch assembly which are not shown. However, it should be noted that the cable and its associated winch mechanism are used to elevate the upper enclosure to a point above the instrument such that it may then be lowered, if desired. Thus, access to the gyrocompass is still possible and any final adjustments may be carried out.

After all adjustments and calibrations have been accomplished, the upper enclosure is lowered so that it may be lowered to the switch sub 502 by means of the threaded connection described earlier. The assembly is now elevated slightly, the stand 513 may be removed and the complete instrument package may then be lowered into the borehole B and the survey commenced.

The overall length of a typical package of this nature would be 12 to 14 feet. It can be seen that transporting this complete assembly to and from the well location by automobile, light truck or as is required on offshore locations, by aircraft, could be somewhat awkward. The usual procedure, then, is to separate the package at the switch sub 502 and, using suitable protective plugs and closures, transport the equipment into approximately equal size pieces.

In the design of instrument packages for gyrocompass type directional surveying equipment, aside from internal considerations having strictly to do with functioning of the instrument components, one is operating under three primary constraints: size, pressure and temperature. A brief discussion of each follows:

Size—Mentioned earlier was the problem of manageable lengths for transport purposes. Aside from this, length considerations allow considerable latitude in design and represent no serious problems. Not so with diameters. With this equipment, as with most other that is to be run in an oil well borehole, the smaller the better. The tubular members into which this equipment must fit can be quite small. This is particularly true as the drilling progresses to greater and greater depths. As a general rule, the deeper the hole, the smaller its diameter. This infers that the drill pipe used to turn the drill bit will also become smaller and smaller. Couple this with the fact that this equipment often runs inside the drill pipe and the magnitude of the problem becomes apparent. Some wells require instrument packages of 2 inch maximum diameter. Other wells can tolerate somewhat larger diameters but it would be fair to say that any package whose diameter exceeded 3½ inches (88.9 millimeters) would be of little use.

Pressure—Oil wells, during the drilling process, are filled with a fluid known as "drilling mud." This name is misleading inasmuch as this fluid is compounded in a scientific manner to rather exact specifications. Drilling mud has many functions but the one which concerns us is its use as a means of offsetting formation pressures. The specific gravity of the drilling mud can be changed by the addition of various materials. The hydrostatic head then developed by the mud can be such that the formation pressure is exactly balanced. This state of equilibrium is necessary to prevent loss of control or "blowout." While this technique works very vell, it means that the instrument package must be capable of withstanding substantial pressures without collapse or even the slightest leak.

Temperature—As the earth's surface is penetrated deeper and deeper, albeit by a small amount, the bottom of the hole comes closer and closer to the earth's core. This core is believed to consist of molten iron at extremely high temperatures. This is confirmed by the fact that the bottom hole temperature of deep holes increases above surface temperature by a factor as for example 17° F. per 1,000 feet depth (9.45° C. per 304.8 meters). One could therefore expect to encounter temperatures in the neighborhood of 250° F. at 10,000 feet (121.1° C. at 3,048 meters), 330° F. at 15,000 feet (176° C. at 4,572 meters) and 420° F. at 20,000 feet (215.56° C. at 6,096 meters) for example. The operating depth of the instrument package would therefore be limited by its ability to withstand the temperature encountered at that depth.

With the foregoing size, pressure and temperature constraints in mind, it would be of some interest in completing this discussion of the present state of the art regarding directional surveying to determine the safe operating depth for an instrument package designed more or less along the lines of the one used in the example.

Size Constraint—The diameter of the largest component in the subject system would be the gyrocompass 501. These devices are available in diameters as small as 1½ inches (38.1 millimeters). Accordingly, then, the outside diameter of the package need only be enough larger than 1½ inches (38.1 millimeters) to provide a wall thickness sufficient to withstand the given pressure.

Pressure Constraint—If a 2 inch (50.8 millimeters) outside diameter is an acceptable size, then by using a 1½ inch (38.1 millimeter) diameter gyrocompass 501 and allowing some clearance between the gyrocompass 501 and the outer enclosure, a wall thickness of as much as 0.218 inches (5.54 millimeters) would be possible. Using a material with a compressive strength of 100,000 pounds per square inch or 6,802.7 atmospheres of pressure, which material is readily available, and performing the necessary calculations, we find that such an enclosure would have a collapse pressure of about 19,500 pounds per square inch or 1,326.5 atmospheres of pressure. Depending on the specific gravity of the drilling mud in use at the time, this would mean a maximum operating depth for this package of between 15,000 feet to over 25,000 feet (4,572.0 meters to 7,620.0 meters). All of this presupposes glands and seals with commensurate pressure capabilities.

At this point it can be observed that neither size nor pressure represent any insurmountable obstacles to operating depths in the 20,000 plus foot range (6,096 meters). Unfortunately, the same cannot be said for temperature, as will be shown below.

Temperature Constraint—The temperature limitation on most commonly available electrical and electronic components as well as the camera film is 125° C. maximum. This translates to about 260° F. Applying the 17° F. per thousand feet (9.45° C. per 304.8 meters) criterion mentioned earlier and assuming a surface temperature of 70° F. (21.1° C.), we find that the temperature limit imposed by film and electrical components will be reached at 11,000 to 12,000 feet (3,352.8 meters to 3,657.6 meters). This limitation can be mitigated somewhat by operating procedures that do not allow the instrument package to remain beyond this "thermal barrier" for lengths of time longer than that required to heat the package beyond component temperature limits. It can nevertheless be said that the depth limitation on this equipment is imposed by temperature considerations.

The foregoing is a fair representation of the present state of the art as known by the applicant in regard to the present capabilities of directional surveying equipment of the gyrocompass type. Moreover, as far as is known by the applicant, there are at present no gyrocompass type directional survey instruments in commercial use that have a high pressure/temperature capability. There are, however, many magnetic compass systems that—by insulating the instrument in a vacuum flask or Dewar flask and in turn encapsulating the flask in a pressure vessel—achieve a temperature/pressure resistance capability that will allow operation in much deeper and/or hotter holes than can be done with gyrocompass or uninsulated systems.

A typical flask of this type is shown in FIG. 7 of the drawings and consists of the following: an outer tube, as at 524; and an inner tube, as at 525; are welded to a neck fitting, as at 526. The inner tube 525 has its opposite end closed. The outer tube 524 has its opposite end closed except for an evacuation fitting, as at 527. After assembly, a vacuum pump is connected to the fitting 527, and the volume contained between the tubes is evacuated to a pressure of $10^{-4}$ torr or less. At this pressure virtually all heat transfer across the space between the tubes ceases. Radiation heat transfer is reduced by either making the outer surface of the tubes reflective or by placing layers of reflective foil in the evacuated space. To complete the assembly, the flask is fitted with a plug, as at 528, which is fabricated from a metal in which case it functions as a heat sink or from a low heat conductivity material such as plastic, in which case it functions as an insulator. On occasion, the plug will consist of a combination of the two. The plug is usually fitted with an O-ring, as at 529, or similar seals to prevent air entry.

These flasks vary somewhat in their construction, but this is understandable, since their designs are usually proprietary in nature. They all, nevertheless, use as their primary insulating method the evacuated Dewar flask. Although the vacuum flask has been successfully applied to magnetic units, some problems arise when the application thereof to gyrocompass is considered. If one used a single flask to encapsulate the gyrocompass instruments, this flask would have to be much too long to be easily transported. Furthermore it would be difficult, if not impossible, to develop procedures whereby the gyrocompass and other components could be assembled for calibration in the tripod stand and then removed from the stand, placed in the flask and the flask in turn placed in the outer pressure vessel. These problems do not occur in the magnetic units because they do not require extensive calibration, nor are they nearly so long as the gyro units.

In addition to the above, applicant is aware of many U.S. patents pertaining to these type instruments. See, for example, U.S. Pat. No. 1,924,816, granted to Sperry in 1933. In addition, see U.S. Pat. No. 2,187,028, granted to Hendrickson in 1940; U.S. Pat. No. 3,079,696 granted to Van Rooyen in 1963; U.S. Pat. No. 3,753,296 granted to Van Steenwyk in 1973; and U.S. Pat. No. 3,896,412 granted to Rohr in 1975. It will be appreciated by those skilled in the art that neither the state of the art as known by the applicant and fairly well outlined above or any of the above patents suggest or disclose applicant's concept.

SUMMARY OF THE INVENTION

This invention is directed towards overcoming the limitations or disadvantages and problems associated with previous gyroscopic directional instrument systems, particularly the problems having to do with the depth to which devices of this nature heretofore have been restricted. The objectives of the present invention are as follows:

First, to provide a pressure resistance capability of 24,000 pounds per square inch (1,632.7 atmospheres of pressure) which permits operation to depths of 25,000 feet (7,620 meters); if drilling weight is less than 18 pounds per gallon (2.14 kilograms per liter); and 21,000 feet (6,400.8 meters) if less than 22 pounds per gallon (2.62 kilograms per liter).

Second, to provide a temperature resistance capability such that operation for periods of up to 6 hours in wells with bottom hole temperatures of 450° F. (232.2° C.) are possible without damage to either the camera film or any instrument component.

Third, to provide a package having a maximum outside diameter of 3 inches (76.2 millimeters).

Fourth, to provide an interarrangement of pressure vessel and vacuum flask such that transport lengths may be practical for normally encountered transport methods.

Fifth, to provide an interarrangement of pressure vessel and vacuum flask such that calibration and set up procedures vary as little as possible from those presently used for the prior gyrocompass system.

Sixth, to provide an interarrangement of components disposed within the flasks to preclude, insofar as practicable, any untoward structural demands on the vacuum flasks with the object being that of precluding the development of any vacuum leaks, i.e., these vacuum flasks are notorious for their fragility.

Seventh, to provide improved rigidity and alignment of instrument components within the package.

The manner in which each of these objectives has been met will be described below.

Generally speaking, the apparatus of the present invention is intended to be used for the directional surveying of deep wells, i.e., 20,000–25,000 feet range or 6,096 meters to 7,620 meters, and which is specifically identified as a gyroscopic directional survey instrument having a high pressure and a high temperature capability, e.g., 24,000 pounds per square inch, or 1,632.65 atmospheres and 450° F. or 232.22° C. While in its fully assembled configuration, the apparatus may be described as being exceptionally long (or at times unwieldy), e.g., 12 to 16 feet long, or 3.66 meters to 4.88 meters, it is quite remarkable that it does not exceed 3 inches, or 76.2 millimeters in diameter. Therefore, it may readily be lowered into the small diameter steel casings normally defining the walls of these deep wells. In view of its cumbersomeness, it is significant to note that the apparatus may readily be broken down into upper and lower sub assemblies when being transported to or from the well site. Moreover, structure is included for individually protecting each sub assembly from the adverse affects of the extreme pressure and temperature. Therewith, the feasibility of "on site" mating and demating of the sub assemblies is achieved. Equally significant is that structure is included which readily enables the required physical access—at the "on site" location—to the internally disposed gyrocompass, inclinometer, and camera systems, i.e., for the purpose of accomplishing the initial preparations and/or calibration procedures as generally outlined previously.

Pressure Resistance Capability—In order to meet the 24,000 pounds per square inch requirement or 1,632.65 atmospheres, it was necessary to choose a material and wall thickness that would fall within the 3 inch or 76.2 millimeter outside diameter limit. Type 416 stainless steel heat treated has a yield strength for this purpose. Using calculation methods available in any good mechanics of materials text the wall thickness was readily determined to be a nominal 0.344 inches, or 8.74 millimeters. This yields an inside diameter of 2.312 inches or 58.73 millimeters, and with a 1½ inch or 38.1 millimeter diameter gyrocompass, an annulus of 0.406 inches or 10.31 millimeters, more than enough for the vacuum flask. These dimensions were used on the upper section of the package. On the lower section, the maximum component diameter was 1.032 inches, or 26.21 millimeters (the batteries). Therefore, a smaller outside diameter was chosen. Using the above methods and an outside diameter of 2.250 inches, or 57.15 millimeters, a wall thickness of 0.281 inches, or 7.14 millimeters and an annulus of 0.328 inches, or 8.33 millimeters, was readily obtained, here again more than enough for the vacuum flask.

With regard to the points where the tubular pressure vessels interface with the top, bottom or switch subs, the sealing method used is that of conventional rubber O-rings. The design methods are readily available from either machine design text or O-ring manufacturer's literature.

Temperature Resistance Capability—The primary insulating means used in the present device is the vacuum flask or Dewar flask discussed earlier. In addition to the capability of these flasks to resist heat transfer from outside, a metallic heat sink is included in the flask enclosing the gyrocompass. This heat sink serves to mitigate internal temperatures by absorbing heat evolved by the spin motor of the gyrocompass. Without the heat sink, this heat would be available to raise the temperatures of components at a much higher rate.

The application of the vacuum flask to the lower section of the device is, except for the absence of the heat sink, similar to the upper section which will be discussed in detail later in the specification.

Outside Diameter Requirement—The discussion on pressure capabilities showed that the 3 inch or 76.2 millimeter maximum criterion was observed in the design of the device.

Transport Length Requirement—It was determined that the only way in which the apparatus could be made to disassemble into reasonable length components was to insulate the upper and lower sections independently with separate vacuum flasks. This allowed the unit to be "broken" at the switch sub into two parts of manageable lengths. The drawback to this approach is that it allows portions of the switch sub to come into direct contact with the drilling mud. This drilling mud, being at bore hole temperature, conducts heat directly into the switch sub and, if nothing is done, the switch sub then conducts heat into instrument and equipment spaces. The use, however, of an insulator plug described herein has proved (in actual tests) to be adequate to prevent this happening to any significant degree.

Set Up And Calibration Requirement—Reference is made to the discussion of setup and calibration procedures at the beginning of this disclosure and in particular to the stage where the upper pressure vessel is lowered by cable down over the instruments and then coupled to the switch sub. It was felt that in adding the vacuum flask to the system that it must be done in such a manner that the flask need not be handled as a separate piece. Aside from saving the labor required for handling the additional piece, this approach avoids the risk of damage to the flask in handling. In short, if the flask is mechanically integrated into the upper pressure vessel, handling procedures at the well will remain virtually unchanged. The manner in which this is accomplished will be discussed in detail later in the specification. Nevertheless, for maintenance purposes, the flask can easily and quickly be removed by removing the top sub 512 and sliding the flask out.

Vacuum Flask Installation Requirement—The manner in which this requirement for minimum structural loads on the vacuum flask for the upper portion of the apparatus was described above. The lower portion, about which little has been said, has an entirely different set of circumstances surrounding its operation. The lower portion consists in the main of the battery pack used to drive the gyroscope spin motor. The voltage requirement for this motor is 28 volts DC. To insure adequate voltage for the motor, the battery pack is sized so as to supply excess voltage initially, this higher voltage being reduced electronically through a typical voltage regulator system to the requisite 28 volts. Therefore, as the batteries are being drained during the service, their output voltage drops, and when the 28 volt level is reached they are considered spent. Experience has shown that by using "C" or "D" size alkaline type cells, voltage in excess of 28 volts can be maintained sufficiently long for survey purposes if the initial voltage is 40–45 volts. For the subject apparatus a pack consisting of 28 individual "C" cells of 1.5 initial volts each was preferred and has proven to be more than adequate. In order to meet the pressure/size requirement of the outer vessel, it was decided that these cells should be arranged in a single vertical string.

Arranging batteries in a single string must be done with a degree of caution because of the following:

In lowering the device into the bore hole it is quite often subjected to sizable inertia forces caused by either the cable, i.e., due to an abrupt stop of the winch drum, or simply by virtue of the package striking the bottom of the hole. Random forces are also caused as the package strikes the side of the casing or bore hole.

Manifestation of these forces has been observed in the form of indentation or diaphragming of the ends of the cells. Even a small amount of permanent or temporary deformation, while having no apparent effect on cell operation, can cause the net length of the string to change by significant amounts. For instance, a 1/64 inch or approximately 0.4 millimeters deformation per cell will reduce the string length by 7/16 inches or slightly more than 11 millimeters. Any electrical contact used to tap the energy of the battery string must be spring loaded in order to absorb this length change and yet maintain electrical continuity.

Attempts to mitigate inertia effects have taken the form of a large contact spring disposed at the lower end of the string of batteries to act in storing energy which can then be dissipated by harmless oscillations. Unfortunately, this lower spring travel imposes an even greater length variance requirement on the upper spring loaded contact and the upper contact must therefore be designed with this in mind.

The inertia loads, it is felt, are sufficiently large that it would be unwise to impose them in any way on the vacuum flask.

Inertia loads on the vacuum flask are minimized in that when the batteries move downward relative to the apparatus, i.e., because of inertia forces, a portion of the energy present will be stored by a load bearing compression spring. The remaining energy is converted in a manner to be fully disclosed in the specification. Albeit, this arrangement insures that none of the inertia forces will be imposed on the inner wall of the vacuum flask.

Rigidity and Alignment Requirement—Early in this disclosure a description of the arrangement of the instrument components was given and it showed how the gyrocompass, inclinometer, camera and camera battery pack were stacked one on top of the other. Because of their delicate nature, coupling these components together results in connections that are weak, at best, and subject to misalignment or damage if moment loads are imposed on them.

Accordingly, the concept herein disclosed includes structure for establishing a rigid protective light weight casing that may readily be manually placed in its position for circummuring the inclinometer, the camera, and at least a portion of the gyroscopic directional instrument system. Whereby, the likelihood of these instruments sustaining physical damage as a result of accomplishing the mating and unmating steps at the well site is minimized if not precluded. The manner in which this is accomplished will be fully disclosed later in the specification.

A device constructed in accordance with the concept herein disclosed has been built and operated within a 22,000 foot or 6,705.6 meter oil well using 16.6 pounds per gallon or 1.97 kilograms per liter drilling mud and having a bottom hole temperature of 420° F. or 215.6° C. was successfully surveyed just recently. To the best of applicant's knowledge, a well of this temperature and depth has never been surveyed before by using a gyrocompass type directional surveying instrument package.

DESCRIPTION OF THE PREFERRED EMBODIMENT

The heart of the invention resides in the techniques or concepts employed for enclosing and the packaging of the various instruments in general and to the gyrocompass system in particular that is the principal instrument employed with this type system. Therefore, since it is believed that the overall system is new, it is deemed appropriate to direct this disclosure toward the entire system.

Figure 8:
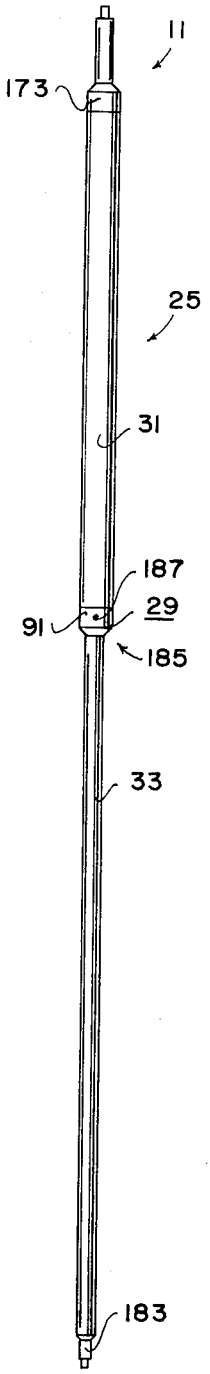
FIG. 8 is side-elevational view drawn substantially to scale of the complete instrument package or gyroscopic directional surveying instrument 11 of the present invention.

The improved gyroscopic directional survey instrument 11 of the present invention is shown substantially to 1/16 scale in FIG. 8 of the drawings. It will be appreciated by those skilled in the art that certain conventional features disclosed herein will be shown in diagrammatic drawing symbols since their detailed illustration is not essential for the proper disclosure of the invention. For example, referring to FIG. 9 of the drawing it will be seen that the gyroscopic directional surveying instrument or apparatus 11 includes a gyrocompass 13 having an electric motor 15 for suitably driving a gimbal arrangement 17, a typical inclinometer 19, and a typical camera 21 having a suitable camera battery pack 23. These various above mentioned instruments are disposed one on top of another substantially in the order depicted in FIG. 9. The manner in which they are made to interface one with the other is deemed to be a typical arrangement.

Figure 2:
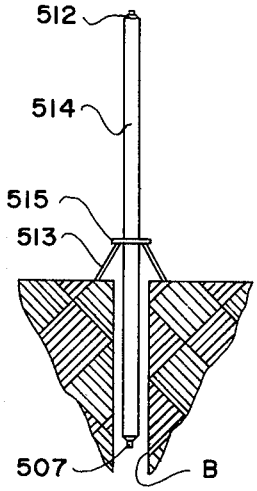
FIG. 2 (PRIOR ART)
Figure 3:
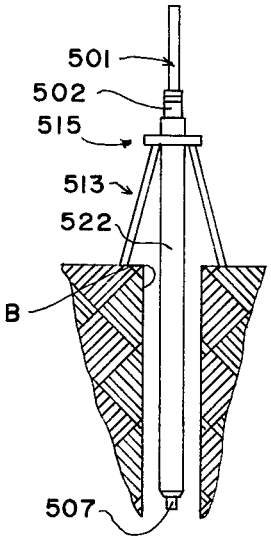
FIG. 3 (PRIOR ART)
Figure 5:
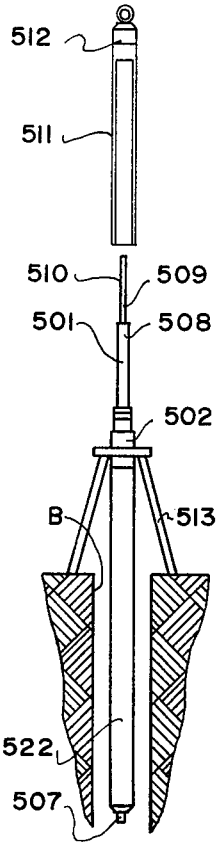
FIG. 5 (PRIOR ART)
Figure 7:
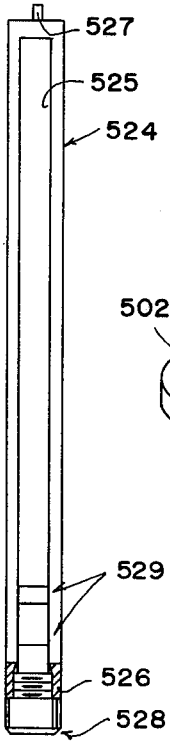
FIG. 7 (PRIOR ART)

The apparatus 11 includes isolation means generally indicated at 25 in FIG. 8 of the drawings for maintaining, at least for a reasonable period of time, a suitable internal environment in which the gyroscopic directional instrument 13 may reliably function while being exposed exteriorly to an extremely hostile environment known to exist at the lower reaches of deep wells which extend several miles into the surface of the earth, like that previously described and as shown in FIGS. 2, 3, and 5 of the drawings. In other words, the isolation means 25 is intended to encompass the entire enclosure and packaging of the above mentioned instruments in general and the gyrocompass 13 in particular, as well as certain ancilliary equipment yet to be mentioned.

Figure 9:
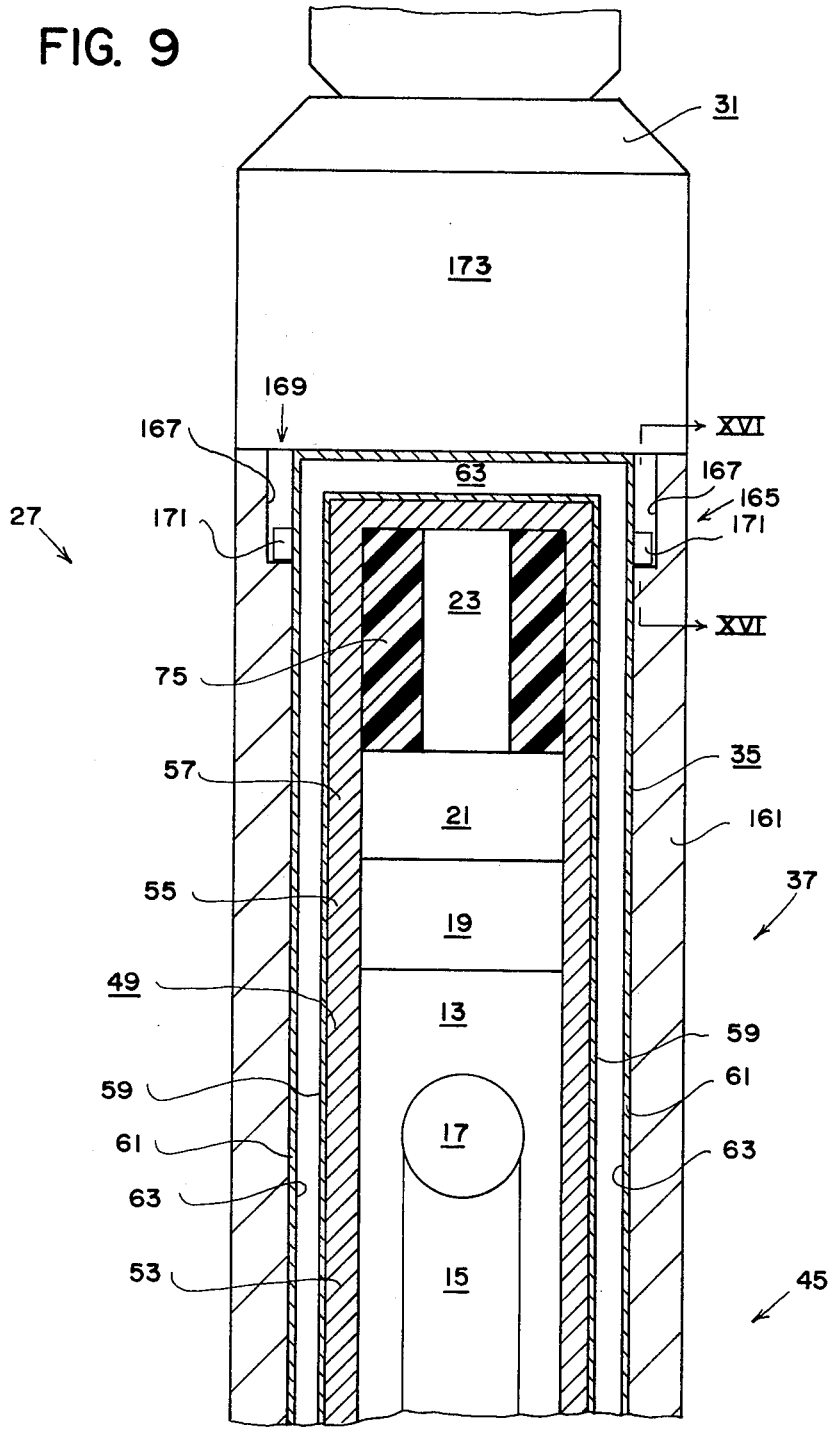
FIGS. 9–11 are enlarged fragmentational sectional views taken along the vertical center line of the instrument shown in FIG. 8 with FIG. 9 being the uppermost portion thereof, FIG. 10 being the medial portion thereof and FIG. 11 being the lower portion thereof.
Figure 10:
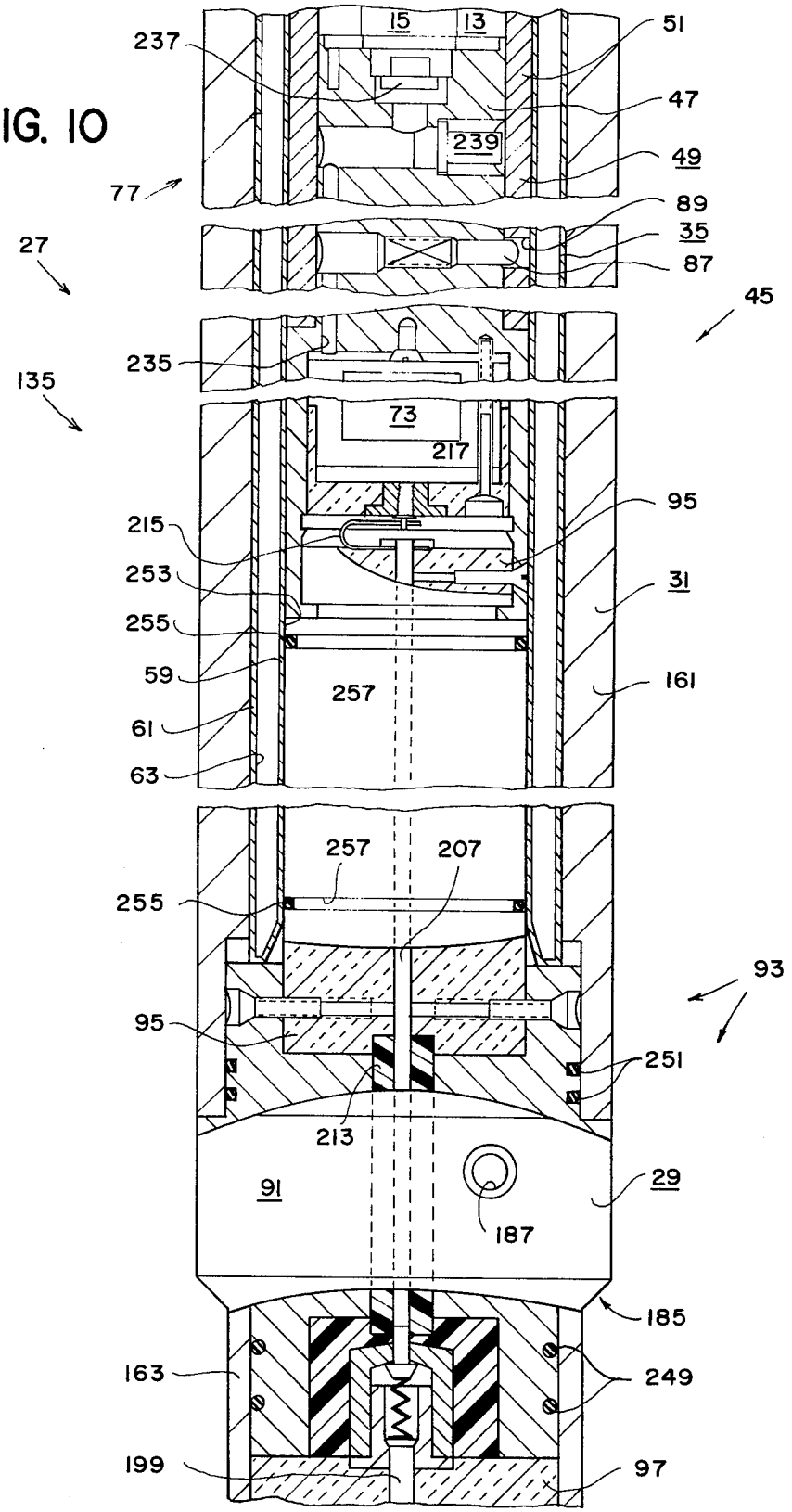
Figure 11:
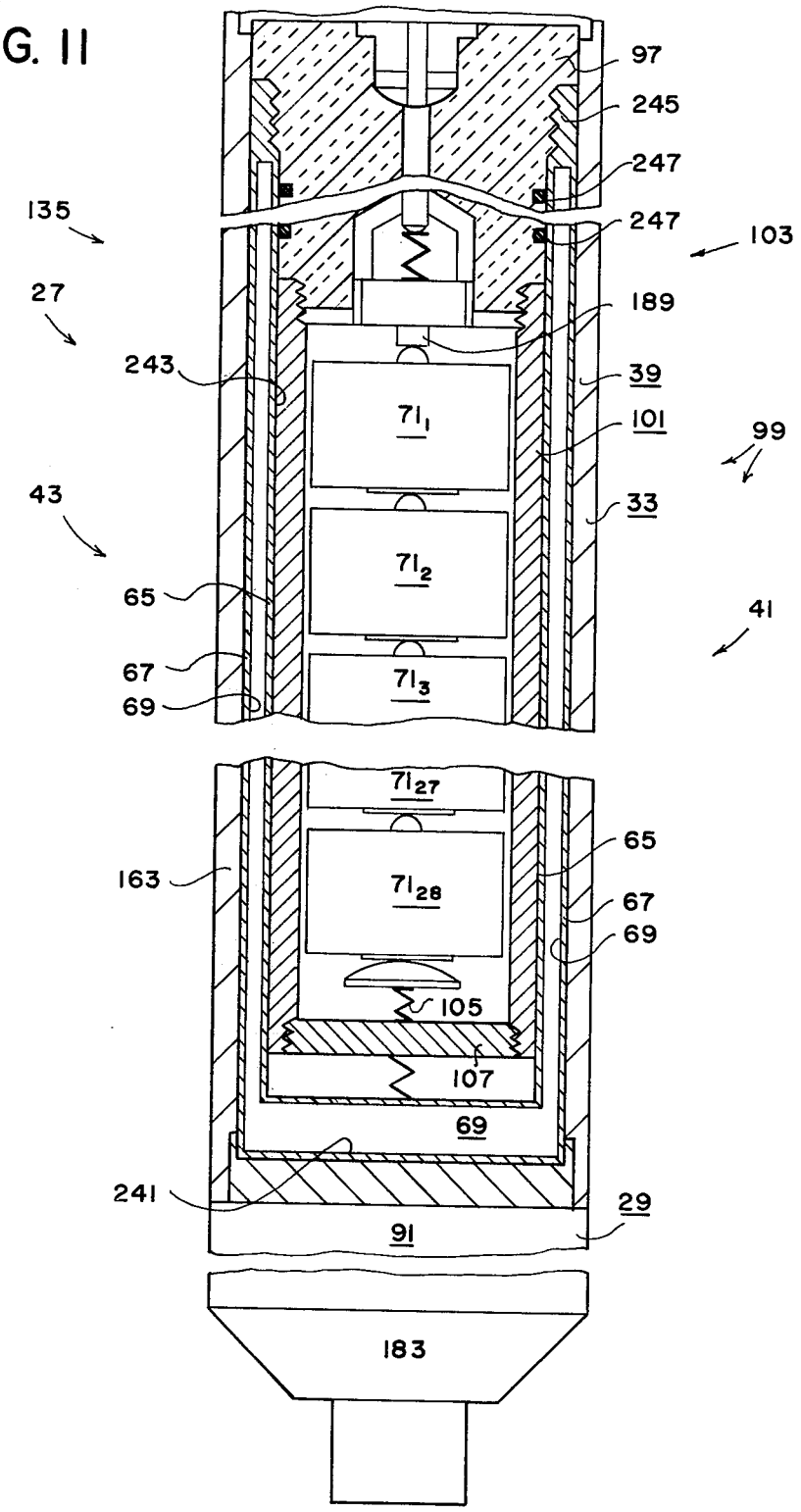

The isolation means 25 comprises heat shield means generally indicated at 27 in FIGS. 9–11 of the drawings, for protecting the gyroscopic instrument system (yet to be described in its entirety) from the extremely hot temperatures inherently existing in the hostile environment. The isolation means 25 also includes interface switch sub means, as at 29, for enabling the apparatus 11 to readily be broken down into upper and lower sub assemblies, as at 31, 33 to facilitate transporting the apparatus 11 between a laboratory-like environment and a well field environment in a manner to be fully disclosed as the specification proceeds.

The heat shield means 27 alluded to above includes an upper Dewar vacuum flask, as at 35, constituting a part of the upper sub assembly 31 for encompassing and heat shielding a first group of component members of the apparatus 11 and which are characterized generally by the numeral 37 in FIG. 9 of the drawings. The heat shield means 27 also includes a lower Dewar vacuum flask, as at 39 in FIG. 11 of the drawings, and which constitutes a part of the lower sub assembly 33 for encompassing and heat shielding a second group of component members of the apparatus 11. The second group of component members are characterized generally therein by the numeral 41. Thus, each of the sub assemblies 31, 33 is independently shielded from the extremely hot temperatures.

The gyroscopic directional instrument system alluded to above includes the previously mentioned electric motor means 15 for driving the gimbal arrangement 17 and a first power supply, characterized by the numeral 43 in FIG. 11 of the drawings, for providing a principal source of electromotive force (EMF) for powering the electric motor means 15.

The isolation means 25 alluded to above includes heat sink means, generally indicated by the numeral 45 in FIGS. 9 and 10 of the drawings, for absorbing, within limits, the heat being generated by the electric motor means 15 as power from the first power supply 43 is being dissipated in the process of maintaining optimum revolutions-per-minute (RPM) of the gimbal arrangement 17.

The heat sink means 45 alluded to above includes a first mass of metal, as at 47 in FIG. 10 of the drawings, which is preferably formed from brass or the like and is disposed adjacent to the electric motor means 15. The heat sink means 45 also includes a second mass of metal, preferably formed from aluminum or the like, and shaped so as to be disposed adjacent the first mass of metal 47 and the electric motor means 15 for readily conducting heat from one to the other.

Moreover, the second mass of metal 49 preferably is tubular shaped wherein a first portion thereof, as at 51 in FIG. 10 of the drawings, is circumposed about at least a portion of the first mass of metal 47 while a second portion thereof, as at 53 in FIG. 9 of the drawings, is circumposed about the electric motor means 15.

In addition, a third portion of the second mass of metal or tubular heat sink means 49 is characterized in FIG. 9 of the drawings by the numeral 55 and is circumposed about the inclinometer means 19.

Further, the tubular shaped sink means 49 includes a fourth portion, as at 57, which is circumposed about the camera means 21.

It will be appreciated by those skilled in the art that the principles of the Dewar flask are well known. Therefore, no attempt will herein be made to describe the details of the Dewar flask. Indeed, it should be sufficient to simply state that the upper vacuum flask 35 includes an inner wall, as at 59, and an outer wall, as at 61, jointly defining an evacuated chamber, as at 63. Likewise, and referring to FIGS. 11, 14 and 15 of the drawings, it may be seen that the lower vacuum flask 39 includes an inner wall, as at 65, an outer wall, as at 67, jointly defining an evacuated chamber as at 69.

The lower vacuum flask 39 primarily is employed for the purpose of shielding the first power supply 43 from the extreme temperatures. The first power supply 43 preferably is comprised of a plurality of single cell battery members 71 which may individually be characterized by the numerals $71_1$, $71_2$, $71_3$, etc. Indeed, the first power supply 43 preferably includes numerous individually cased battery cell members 71 arranged in series in like manner as a typical flashlight, thus establishing a long string of battery cell members 71 having considerable weight. For example, the first power supply 43 may include 28 such batteries 71 which preferably are well known "C" cells of 1.5 initial volts each, thus providing an initial voltage of 40 to 45 volts.

The gyroscopic directional instrument system includes voltage regulator means, as at 73, which is interposed between the first power supply 43 and the electric motor means 15 for regulating the voltage output, i.e., 40 to 45 volts of the first power supply 43. Thus, the voltage being applied to the electric motor means 15 remains within certain acceptable limits, e.g., 28 volts or the like, even though the voltage output of the first power supply 43 may vary exceedingly beyond the certain acceptable limits.

It should be understood that the camera battery pack 23 mentioned previously may optionally hereinafter be referred to as a second source of EMF. While the second source of EMF 23 will not be described in detail, it should be noted in FIG. 9 of the drawings that the second source of EMF 23 is smaller in diameter than are the other instruments 13, 19, 21. Therefore, from FIG. 9 of the drawings it may be seen that the second power supply 23 is surrounded by a toroidal shaped shock absorber or buffer, as at 75. The interior annular surface of the buffer 75 is compatibly shaped with the second power supply 23 so as to be a rather close fit. While the outer annular surface thereof preferably is compatibly sized with the exterior surfaces of the instruments 13, 19, 21. The buffer 75 preferably is formed from a substance having a degree of resiliency, e.g., polyethylene or the like, for the reasons which will be apparent as the specification proceeds.

Particular attention is now directed toward FIG. 10 of the drawings wherein it may be seen that the first and second masses of metal 47, 49 are compatible in size and shape to enable the first portion 51 of the tubular shaped heat sink means 49 to be slip fitted over the first mass of metal 47, i.e., so as to not only be contiguous therewith but to also provide a degree of rigidity to the tubular shaped heat sink means 49 for reasons yet to be disclosed.

The heat sink means 45 also includes quick disconnect fastener means, generally indicated at 77 for:

Firstly, rigidly joining the first and second masses of metal 47, 49 together and Secondly, facilitating expediency in separating the first and second masses of metal 47, 49 one from the other.

Figure 12:
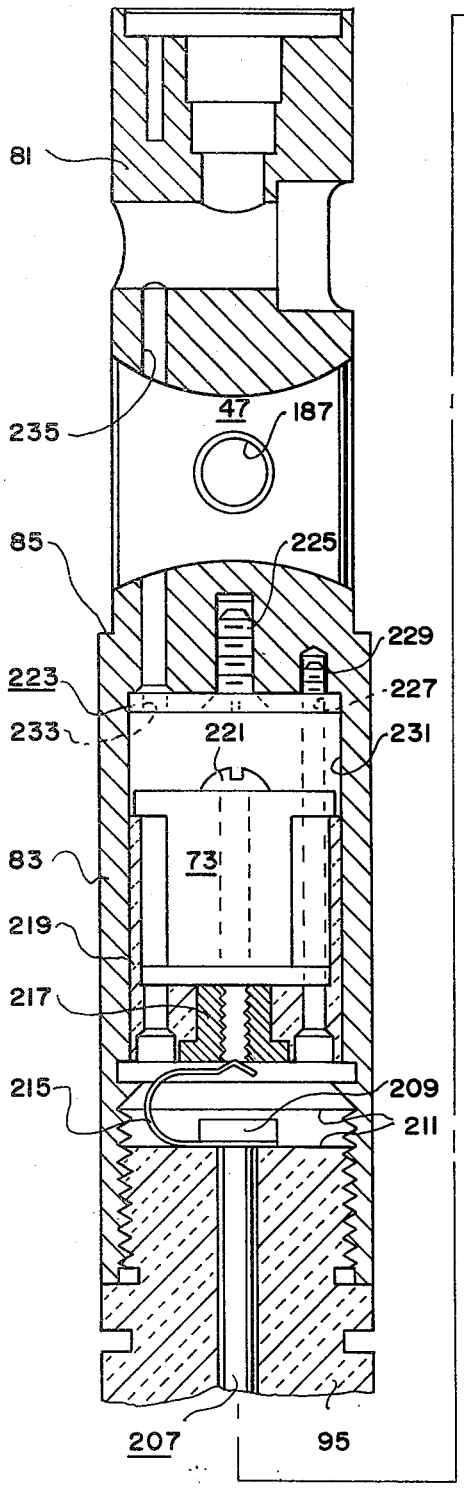
FIGS. 12 and 13 jointly depict structure shown in FIG. 10; however, certain structure has been deleted for clarity.

From FIG. 12 of the drawings it may be seen that the first mass of metal 47 is provided with a reduced diameter portion, as at 81, and a larger diameter portion, as at 83, thus a shoulder, as at 85, is established.

Referring again to FIG. 10 of the drawings, it may be seen that the quick disconnect fastener means 77 includes spring loaded plunger means, as at 87, which is suitably attached to the first mass of metal 47 for coacting with an aperture, as at 89, provided in the tubular shaped mass of metal 49.

The plunger means 87 and the aperture 89 are interarranged to selectively enable the plunger means 87 to be made to register (close fittingly) with the aperture 89, when the tubular shaped mass of metal 49 is properly slip fitted over the first mass of metal 47. That is, the tubular shaped mass of metal 49 abuttingly engages the shoulder 35 (FIG. 12), thus precluding inadvertent separation of the first and second masses of metal 47, 49.

Stated another way, the tubular heat sink means 49 may also be described as means for establishing a rigid protective light weight casing that may readily be manually placed in its position for circummuring the inclinometer means 19, the camera means 21, and at least a portion of the gyroscopic directional instrument system, i.e., the gyrocompass 13 and the electric motor 15, whereby the likelihood of these instruments sustaining physical damage as a result of accomplishing certain mating and/or unmating steps is minimized if not precluded.

In addition, the close fit of the tubular heat sink means 49 with the shock absorber or buffer 75 prevents sidewise inertia effects from imposing moment loads on the instrument connection.

From FIG. 10 of the drawings it may be seen that at least a portion of the outer circumferential surface, as at 91, of the interface switch sub means 29 constitutes a medial portion of the outer surface of the apparatus 11 per se as shown in FIG. 8 of the drawings. Moreover, this results in the interface switch sub means 29 being directly exposed to the extremely hot temperatures. Therefore, the isolation means 25 alluded to includes heat insulation means, generally indicated by the numeral 93 in FIG. 10 of the drawings, for preventing any rise in temperature of the interface switch sub means 29 from adversely affecting certain components which may be housed within the upper and lower sub assemblies. The insulation means 93 preferably is formed from a substance selected for its heat insulation ability, e.g., Nema G-10 glass-epoxy and the like.

More specifically, the heat insulation means 93 includes switch sub heat insulation means, as at 95, for minimizing any heat transfer from the interface switch sub means 29 to certain components which may be housed within the upper sub assembly, i.e., the gyrocompass 13, etc. In addition, the heat insulation means 93 includes battery pack heat insulation means, as at 97 in FIGS. 10 and 11 of the drawings, for minimizing any heat transfer downwardly from the interface switch sub means 29 to the second group of components members 41, i.e., the first power supply 43. Thus, the temperature of the first and second groups of component members 37, 41 is not adversely affected by any rise in temperature of the interface switch sub means 29.

Particular attention is now directed towards FIG. 11 of the drawings wherein it may be seen where the apparatus 11 includes load transition means, as generally indicated by the numeral 99 therein, for precluding any inertia loads attributable to the weight of the long string of battery cell members 71 from acting adversely upon the lower vacuum flask 39.

More specifically, the load transition means 99 alluded to above includes providing battery tube means, as at 101, for containing the string of battery cell members 71, i.e., the battery tube means 101 is disposed within the lower vacuum flask 39. In addition, the load transition means 99 includes support means, as at 103, for supporting the battery tube means 101 merely from the upper end thereof. In this manner, the battery tube means 101 totally depends from the support means 103 and extends downwardly into the lower vacuum flask 39.

In addition, the load transition means 99 includes shock absorbor means, as at 105, which is disposed at the closed bottom, as at 107, of the battery tube means 101 with the lowermost one of the string of battery cell members, e.g., the battery $71_{28}$ being restingly supported by the shock absorber means 105.

Figure 14:
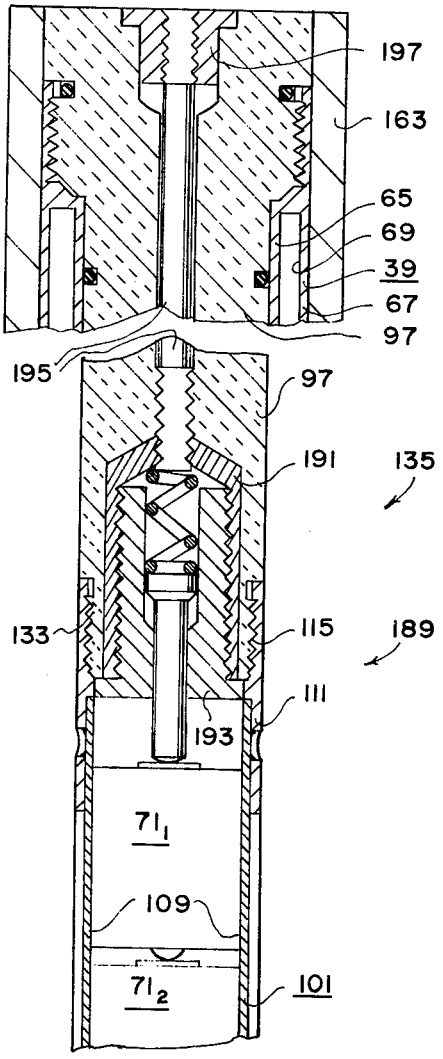
FIGS. 14 and 15 jointly depict enlarged structure shown in FIG. 11; however, certain structure has been deleted for clarity.
Figure 15:
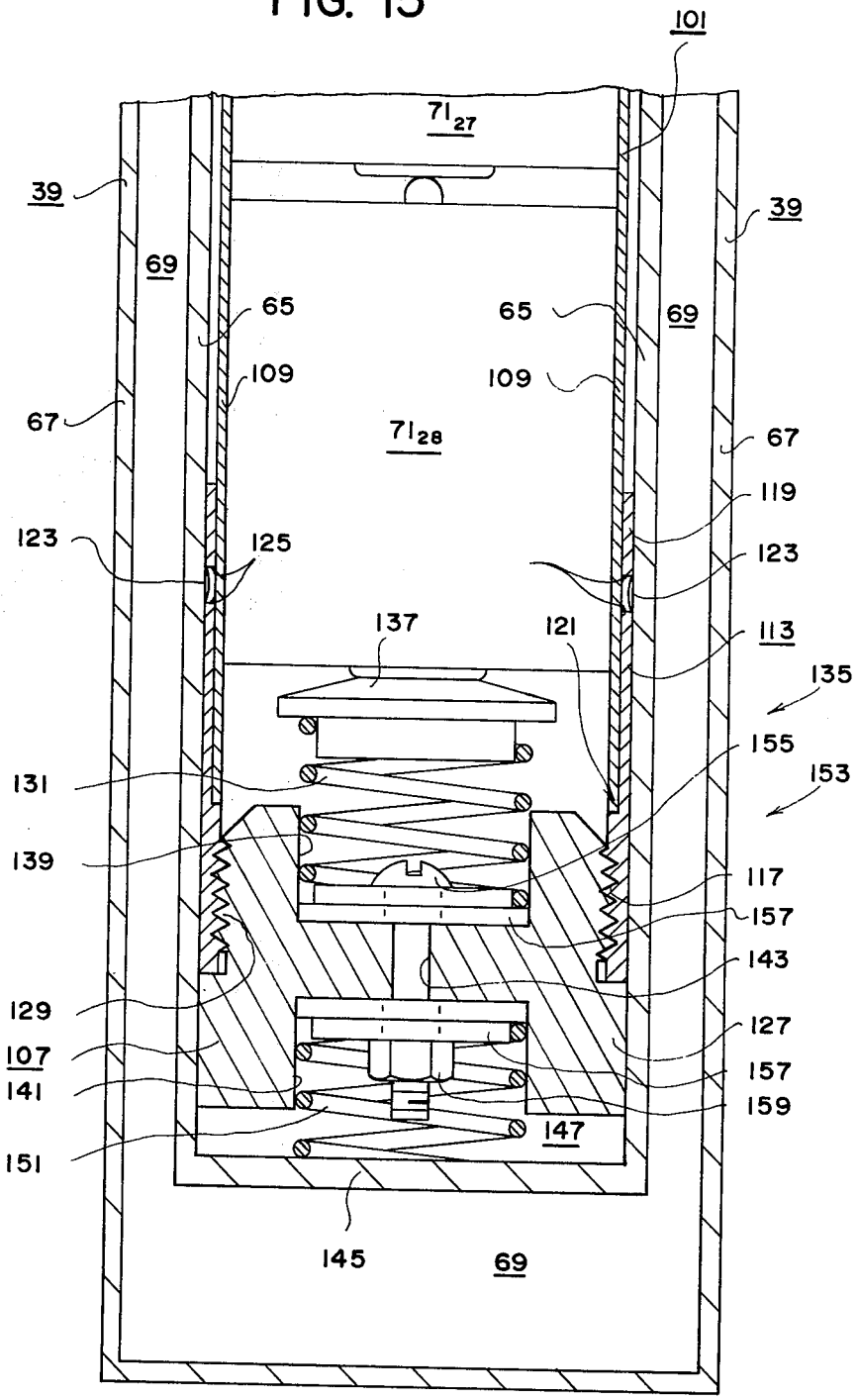
Figure 17:
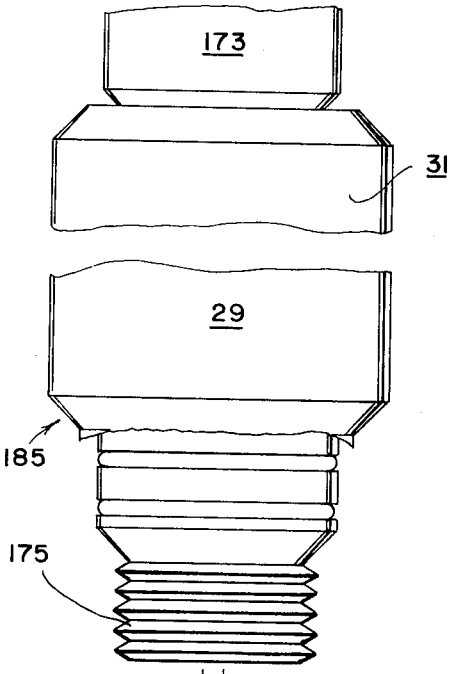
FIGS. 17–18 are intended to depict the manner in which the apparatus may be readily broken down into upper and lower sub assemblies, with FIG. 19 showing an internally threaded protective cap adapted to threadedly engage the upper sub assembly (FIG. 17), and FIG. 20 depicting an externally threaded protective plug adapted to threadedly engage the lower sub assembly (FIG. 18).
Figure 19:
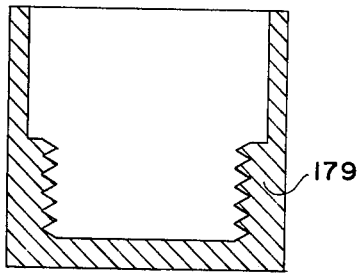

Particular attention is now directed towards FIGS. 14 and 15 of the drawings wherein it may be seen that the battery pack heat insulation means 97 forms a plug for the lower vacuum flask 39. Also, it may be seen that the battery tube means 101 alluded to above includes an intermediate tubular member, as at 109, interposed between upper and lower sleeve-like members 111, 113 respectively. Both of the sleeve-like members 111, 113 are provided with internally threaded portions, as at 115, 117 respectively. With the upper internally threaded sleeve-like member 111 constituting, at least in part, the support means 103 alluded to above.

The remote ends of the intermediate tubular member 109 are fixedly attached respectively to the upper and lower sleeve-like members 111, 113 in a manner to be described with the internally threaded portions 115, 117 thereof being outwardly directed.

The preferred manner of attaching the sleeve-like mmebers 111, 113 to the tubular member 109 is as follows: (Since both of the sleeve-like members 111, 113 are attached in exactly the same manner, the disclosure will be limited to only one of the sleeve members, i.e., the lower sleeve member 113.) The sleeve-like member 113, being of considerably heavier material than is the tubular member 109, is provided with an enlarged internal diameter portion, as at 119, thus establishing a shoulder, as at 121. The enlarged diameter portion 119 is compatibly sized so as to enable the tubular member 119 to be slip fitted internally thereof so as to abuttingly engage the shoulder 121. In addition, the enlarged diameter portion 119 is provided with a plurality of apertures, as at 123, which overlay the tubular member 109. The apertures 123 provide a suitable opening for receiving rosette welds, as at 125. Thus the sleeve-like member 113 is welded to the tubular member 109, i.e., the welds 125 do not protrude outwardly beyond the outer surface of the sleeve-like member 113.

The bottom 107 of the battery tube means 101 includes contact plug means 127 as best shown in FIG. 15 of the drawings, which is provided with an externally threaded portion, as at 129, for threadedly engaging the internally threaded portion 117, thus providing removable means for closing the bottom of the battery tube means 101.

The shock absorber means 105 alluded to above includes load-bearing compression spring means, as at 131 in FIG. 15 of the drawings, which is restingly supported upon the contact plug means 127. Thus, the weight of the long string of battery cell members 71 is initially carried by the load bearing compression spring means 131, thence by the contact plug means 127 (which depends from the lower sleeve-like member 113), thence longitudinally upwardly along the intermediate tubular member 109 where it is finally carried by the upper sleeve-like member 111, which constitutes, at least in part, the support means 103. It should be mentioned that the internally threaded portion 115 of the upper sleeve-like member 111 (FIG. 14) threadedly engages an externally threaded portion, as at 133, of the battery pack heat insulation means 97. In addition, since the battery pack heat insulation means 97 preferably is formed from glass epoxy, it, of course, is not only a heat insulator, as mentioned earlier, but is also an electrical insulator, the significance of which is about to be disclosed.

Both of the vacuum flasks, preferably being formed from stainless steel or the like, may readily be used, if desired, for conducting electricity. Therefore, the lower vacuum flask 39 is utilized for this purpose. In addition, the battery tube means 101 includes (at least in part) circuit means, generally indicated by the numeral 135 in FIGS. 10 and 11, for providing electrical continuity between the lowermost one of the string of battery cell members 71 and the lower vacuum flask 39. In this manner, the vacuum flask 39 may be utilized for providing, at least in part, an electrical circuit for interconnecting the electric motor means 15 and the first power supply 43.

Particular attention is again directed towards FIGS. 14 and 15 of the drawings wherein it may be seen that the circuit means 135 alluded to above includes a contact head member 137 preferably formed from brass or the like for engaging and thus establishing an electrical contact with the lowermost one of the batteries $71_{28}$. The contact plug means 127, preferably being formed from stainless steel or the like, includes inwardly and outwardly directed cup-like portions, as at 139, 141 respectively, communicated one with the other by an aperture, as at 143, provided therethrough. In addition, the load-bearing compression spring means 131 is disposed at least in part within the inwardly directed cup-like portion 139 and engages the contact head member 137 for making an electrical circuit between the contact head member and the contact plug means 127.

It should be understood that the vacuum flasks 35, 37 are notoriously fragile. Therefore, even though the lower vacuum flask 39 has a closed bottom, as at 145, it is incapable of assuming any of the inertia load which may be generated by the first power supply 43. Accordingly, even though the contact plug means 127 is disposed adjacent the fragile closed bottom 145, a definite spaced distance, as at 147, must be established between the bottom 145 of the lower flask 39 and the contact plug means 127.

The circuit means 135 alluded to also includes electrical conductor non-load-bearing compression spring means 151, which is disposed within the spaced distance 147 or at least in part within the outwardly directed cup-like portion 141 and which bears against both the contact plug means 127 and the fragile closed bottom 145 of the lower vacuum flask 39. The circuit means 135 also includes fastener means, as at 153, having a portion (or bolt member 155) extending through the aperture 143 for attaching the load bearing compression spring means 131 with the electrical conductor non-load-bearing compression spring means 151. Thus, the electrical continuity between the lowermost one of the string of battery cell members $71_{28}$ and the vacuum flask 39 is provided. It should be mentioned that the fastener means 153 preferably includes a pair of shoulder washers, as at 157, and a nut 159.

Particular attention is again directed towards FIGS. 9–11 and 16 of the drawings wherein it may be seen that the upper and lower sub assemblies 31, 33 respectively, include upper and lower pressure vessels, as at 161, 163 for enabling the apparatus 11 to withstand the tremendous pressure inherently existing in the previously described hostile environment. Moreover, it should be noted with reference also being made to FIG. 16 that the apparatus 11 includes means generally indicated at 165 for maintaining a mechanical solidarity of at least the upper vacuum flask 35 and the upper pressure vessel 161, even though the upper pressure vessel 161 may be removed from the interface switch sub means, i.e., for the purpose of accomplishing the necessary initial preparations and/or calibration procedures at the well site.

Figure 16:
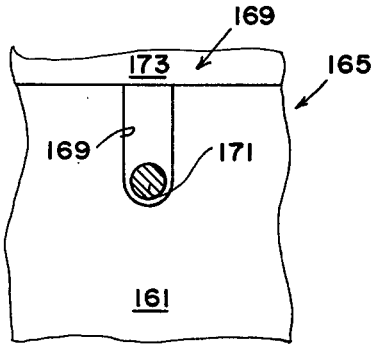
FIG. 16 is a sectional view taken as on the line XVI—XVI of FIG. 9 of the drawings.

More specifically, the means 165 alluded to above includes providing the pressure vessel 161 with a pair of vertically disposed elongated slots, as at 167, which are disposed substantially 180° one from the other and which lead upwardly to mouth-like openings, as at 169 in FIG. 16 of the drawings. The flask 35 includes a pair of projecting ears or lugs, as at 171, which are adapted for registration with the slots 167, i.e., being admitted into the slots through the mouth-like openings 169. It should be understood that the upper sub assembly 31 includes a top sub, as at 173, which corresponds to the top sub 512 of the prior art above described. Therefore, it should be sufficient to simply state that the top sub 173 is threaded onto the upper pressure vessel 161 in a manner well known to those skilled in the art. Of course, the top sub 173 closes the mouth-like openings 169. Therefore, the ears 171 are captured within their respective slots 167 when the upper pressure vessel (161 being attached to the top sub 173) is lifted to perform the calibration procedures, etc., at the well site.

Particular attention is now directed towards FIG. 17–20 of the drawings wherein it may be seen that the interface switch sub means 29 is provided with an externally threaded downwardly directed terminus, as at 175, and the lower sub assembly 33 is provided with an internally threaded socket, as at 177, adapted to threadedly engage the downwardly directed terminus 175. It is significant to note that the apparatus 11 includes internally threaded protective cap means, as at 179, adapted to threadedly engage the externally threaded terminus 175 of the switch sub means 29 for providing protection thereof when the apparatus 11 is broken down in the manner above described. In addition, the apparatus includes externally threaded protective plug means, as at 181, adapted to threadedly engage the threaded socket 177 of the lower sub assembly 33 for providing protection thereof when the apparatus is broken down. Of course, the apparatus 11 includes a bottom sub, as at 183, which threadedly engages the lower pressure vessel 163 in somewhat the same manner as does the top sub 173.

Figure 1:
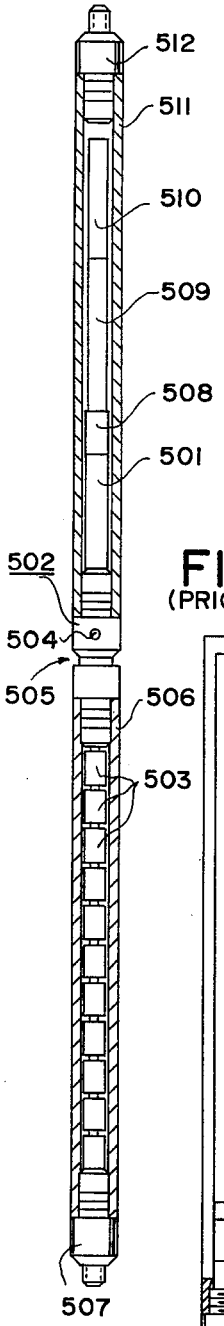
FIG. 1 (PRIOR ART)
FIGS. 1–7 depict various arrangements of the prior art.
Figure 4:
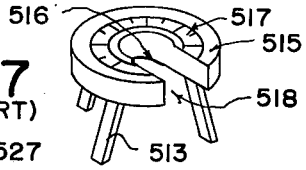
FIG. 4 (PRIOR ART)

The switch sub means 29 is provided with a tapered surface, as at 185, which corresponds to the groove 505 as shown in FIG. 1, for the prior art. Therefore, the tapered surface 185 enables the apparatus 11 to be adapted to the plate 515 as shown in FIGS. 4 and 6 of the drawings.

Figure 6:
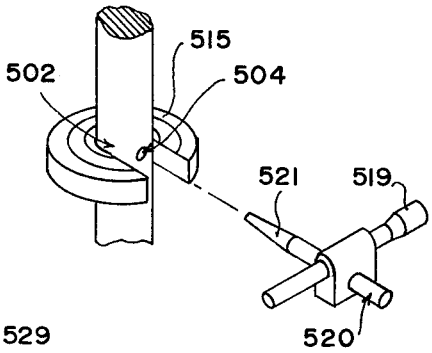
FIG. 6 (PRIOR ART)

Additionally, the switch sub means 29 is provided with a tapered hole, as at 187, which corresponds to the tapered hole 504 as shown in FIGS. 1 and 6 of the drawings. Therefore, the apparatus 11 may readily receive the standard telescope type transit instrument 519 as shown in FIG. 6 of the drawings for the purposes outlined earlier in the specification.

Figure 13:
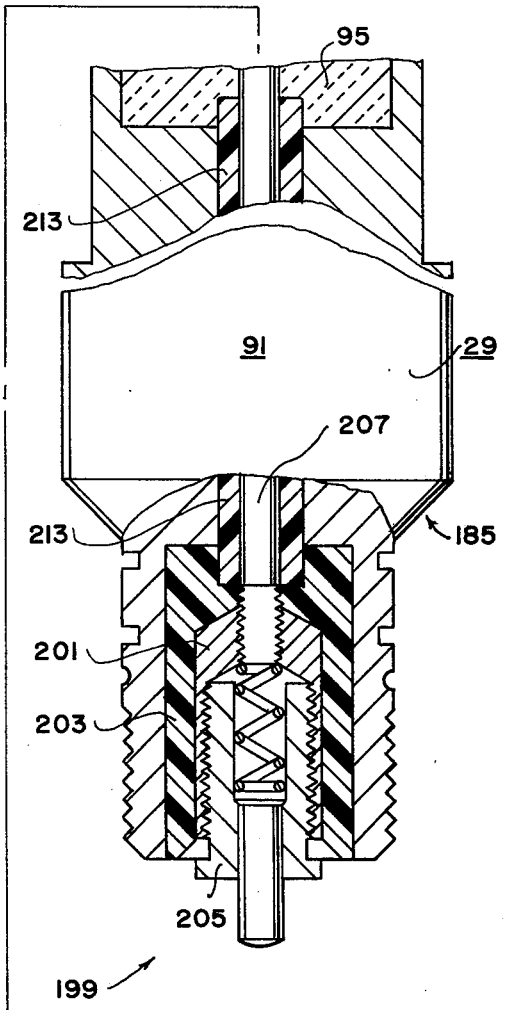

Referring again to FIGS. 12–14 of the drawings, it may be seen that the circuit means 135 also includes a first or lower spring loaded plunger assembly, as at 189, which is supported within a suitable socket provided in the battery-pack heat insulation means 97. More specifically, a metallic contact sleeve, as at 191, is adapted to simply slip into the socket provided in the insulation means 97. In addition, a plunger retainer, as at 193, is adapted to threadedly engage the contact sleeve 191, thus capturing the plunger assembly 189.

In addition, a battery pack tie rod, as at 195, preferably formed from stainless steel or the like is included and which has external threads provided at either end thereof. The lower end of the tie rod 195 threadedly engages the contact sleeve 191 while the upper end thereof threadedly engages a first contact button, as at 197. The contact button 197 is simply slip-fitted into an upper socket provided in the heat insulation means 97. Of course, since the tie rod 195 joins the contact sleeve 191 to the first contact button 197, they are captured in their respective sockets.

The circuit means 135 also includes a second or upper spring loaded plunger assembly, as at 199 (FIG. 13) which is very similar to the just described lower spring loaded plunger assembly 189. More specifically, a contact sleeve 201 is slip fitted into a contact insulator, as at 203, which is preferably formed from glass epoxy or the like. The contact insulator 203 is slip fitted into a socket provided in the switch sub body 29 and a plunger retainer, as at 205, threadedly engages the contact sleeve 201.

A switch sub tie rod, as at 207, preferably formed from stainless steel or the like, is included and has the lower end thereof provided with external threads for suitably engaging the contact sleeve 201. The upper end of the tie rod 207 is provided with an enlarged square head, as at 209, which is fitted into an elongated channel, of which the back wall is shown, as at 211, that is suitably provided in the upper end of the switch sub insulation means 95.

A tie rod insulation tube, as at 213, preferably formed from glass epoxy extends through the metal body of the switch sub means 29. The lower end of the insulation tube 213 is received in a suitable socket provided in the contact insulator 203 and the upper end thereof is suitably received in a socket provided in the switch sub heat insulation means 95. The switch sub tie rod 207 extends through the tie rod insulation tube 213.

The circuit means 135 also includes a leaf spring contact member, as at 215 (FIG. 12) which is captured by the tie rod 207. More specifically, the spring contact member 215 is provided with a suitable aperture (not shown) through which the tie rod 207 extends, i.e., being mated prior to the lower end thereof having been threadedly received by the contact sleeve 201.

Also included is a second contact button, as at 217, preferably formed from brass or the like, and which is slip-fitted into a suitably sized socket provided in a voltage regulator housing, as at 219, which is preferably formed from Delrin or the like.

The voltage regulator 73 is attached to the voltage regulator housing 219 by a bolt 221 which has the lower end thereof threadedly received within the second contact button 217. In this manner, electrical contact is also made from the contact button 217 to the voltage regulator 73.

A tapped plate, as at 223, is attached to the first mass of metal 47 by a bolt 225. The tapped plate 223 has a pair of tapped holes, as at 227 (only one of which is shown), for receiving a pair of bolts (only one is shown) as at 229. More specifically, the voltage regulator housing 219 is slip fitted into a socket, as at 231, i.e., provided in the mass of metal 47, after the voltage regulator 73 is attached thereto, and the bolts 229 capture the assembly within the socket 231.

The tapped plate 223 is provided with an aperture, as at 233, which is adapted to be in alignment with an elongated channel, as at 235, which is also provided in the first mass of metal 47.

Referring briefly to FIG. 10 of the drawings wherein it may be seen that a suitable disconnect plug, as at 237, is included as a member of the circuit means 135. Accordingly, it may readily be seen that suitable electrical conductors (not shown) may be made to extend through the aperture 233 and the elongated channel 235 for connecting the disconnect plug 237 with the voltage regulator 73. Of course, the gyro-compass 13 is provided with a suitable compatible disconnect plug (not shown) for electrical engagement with the disconnect plug 237, i.e., thus connecting the electric motor 15 with the just described circuit means 135.

It should also be mentioned at this point that the apparatus 11 is provided with suitable means, as at 239 (FIG. 10), for making the necessary electrical connection when performing the initial preparations and/or calibration procedures at the well site. Of course, the means 239 will include switch means (not shown) for starting the electric motor 15.

Operation—the apparatus 11 is intended to be transported to the well site in a broken down configuration. More specifically, the upper and lower sub assemblies 31, 33 are separated at the threaded terminus 175 (FIG. 17) and the protective cap means 179 is suitably placed over the threaded terminus 175.

Figure 18:
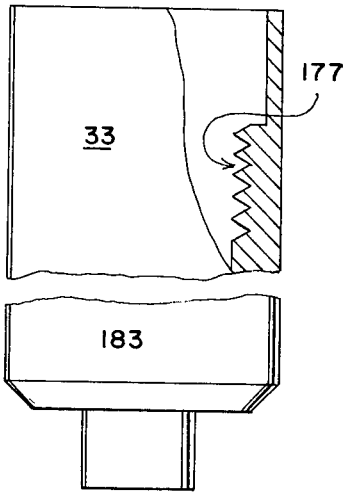
Figure 20:
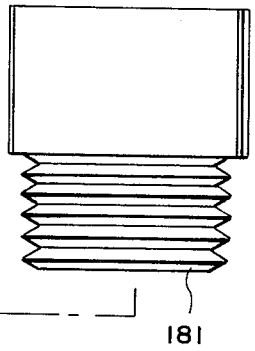

Likewise, the protective plug means 181 is suitably inserted in the socket 173 (FIG. 18). Therefore, the apparatus 11 may quickly and easily be reassembled at the well site to the configuration of that shown in FIG. 8 of the drawings. The set up and calibration procedures for the apparatus 11 are substantially identical to the set up and calibration procedures of the previous gyrocompass directional surveying instrument and as fully outlined earlier in the specification. However, a few significant features of the apparatus 11 will be discussed briefly and with particular reference being made to FIGS. 9 and 10 of the drawings.

The upper pressure vessel 161 is adapted to threadedly engage the switch sub means 29, i.e., even though thread structure is not shown in FIG. 10 of the drawings. Thus, the upper pressure vessel 161 is disengaged from the switch sub means 29 while it is restingly supported by the arrangement as shown in FIG. 5 of the drawings. As mentioned previously, the upper vacuum flask 35 is removed simultaneously with the upper pressure vessel 161, thus exposing the tubular heat sink means 49 which is very light weight aluminum or the like. Therefore, depressing on the spring loaded plunger means 87 enables the tubular heat sink means 49 to be manually lifted upwardly so as to gain access to the above mentioned means 239 for accomplishing the initial preparations and/or calibration procedures.

After these procedures are completed, the tubular heat sink means 49 may be replaced by bringing it down over the various instruments, i.e., not only the gyrocompass 13, but the inclinometer 19 and the camera means 21. It will be obvious to those skilled in the art that due to the delicate nature of these instruments, coupling these components together results in connections that are weak at best and subject to misalignment or damage if moment loads are imposed on them. Therefore, the tubular heat sink means 49 precludes the likelihood of these instruments sustaining physical damage as a result of removing and replacing the upper pressure vessel 161.

The shock absorber 75 (FIG. 9) registers with the inside of the tubular heat sink means 49 for precluding any shifting of the instruments contained within the tubular heat sink means 49.

Inertia loads on the lower vacuum flask 39 (FIG. 11) are minimized in that when the batteries 71 move downward relative to the apparatus 11 because of inertia forces, a portion of the energy present will be stored by the shock absorber means 105, i.e., the load bearing compression spring means 131 (FIG. 15). The remaining energy is converted to a force on the contact plug means 127 which transfers this force to the battery tube means 101, the battery tube means 101 to the battery pack heat insulation means 97, thence to the outer wall 67 of the vacuum flask 39. This arrangement insures that none of the inertia forces will be imposed on the inner wall 65 of the vacuum flask 39, but rather on the outer wall 67 which, being of a heavier material, is better able to withstand the same. The spring loaded plunger assembly 189 has sufficient travel capability to accommodate battery movements and yet maintain optimum electrical continuity.

From FIG. 11 of the drawings it may also be seen that the bottom sub 183 has machined into it a socket, as at 241, for accommodating the bottom of lower vacuum flask 39. The interior space, shown as at 243, but which also includes the spaced distance 147 (FIG. 15), of the lower vacuum flask 39, is sealably closed at its upper end by the battery pack heat insulation means 97 which engages the flask 39 by means of a threaded connection, as at 245. The heat insulation means 97 is fitted with O-rings, as at 247, to prevent air entry into the interior storage space 253 of the vacuum flask 39.

In addition, O-rings, as at 249 (FIG. 10), provide an air-tight seal between the switch sub means 29 and the lower pressure vessel 163. Likewise, O-rings, as at 251, provide an air-tight seal between the switch sub means 29 and the upper pressure vessel 161.

The interior or storage space, as at 253, of the upper vacuum flask 35 is provided with an air tight seal by a pair of O-rings, as at 255, i.e., the O-rings 255 being received in grooves, as at 257, provided in the switch sub heat insulation means 95.

Although the invention has been described and illustrated with respect to a preferred embodiment thereof, it should be understood that it is not intended to be so limited since changes and modifications may be made therein which are within the full intended scope of the invention.

I claim:

1. An improved well surveying apparatus comprising, in combination, a gyroscopic directional instrument system, and isolation means for maintaining, at least for a reasonable period of time, a suitable internal environment in which said gyroscopic directional instrument system may reliably function while being exposed exteriorly to an extremely hostile environment known to exist at the lower reaches of deep wells which extend several miles into the surface of the earth, said gyroscopic directional instrument system including electric motor means for driving a gimbal arrangement and a first power supply for providing a principal source of electromotive force (EMF) for powering said electric motor means; said isolation means including heat sink means for absorbing, within limits, the heat being generated by said electric motor means as power from said first power supply is being dissipated in the process of maintaining optimum revolutions-per-minute (RPM) of said gimbal arrangement, said heat sink means including a first mass of metal disposed adjacent said electric motor means and a second mass of metal shaped so as to be disposed adjacent said first mass of metal and said electric motor means for readily conducting heat from one to the other; said second mass of metal (constituting in part said heat sink means) being tubular shaped, said first and second masses of metal being compatible in size and shape to enable a portion of said tubular shaped heat sink means to be slip fitted over said first mass of metal; said heat sink means including quick disconnect fastener means for: (1) rigidly joining said first and second masses of metal together, and (2) facilitating expediency in separating said first and second masses of metal one from the other.

2. The combination as set forth in claim 1 in which said quick disconnect fastener means includes spring loaded plunger means attached to said first mass of metal and an aperture provided in said tubular shaped mass of metal, said plunger means and said aperture being arranged to selectively enable said plunger means to be made to register close fittingly with said aperture when said tubular shaped mass of metal is properly slip fitted over said first mass of metal thus precluding inadvertent separation thereof.

3. An improved well surveying apparatus comprising, in combination, a gyroscopic directional instrument system, and isolation means for maintaining at least for a reasonable period of time a suitable internal environment in which said gyroscopic directional instrument system may reliably function while being exposed exteriorly to an extremely hostile environment known to exist at the lower reaches of deep wells which extend several miles into the surface of the earth, said isolation means comprising heat shield means for protecting said gyroscopic directional instrument system from the extremely hot temperatures inherently existing in said hostile environment, and interface switch sub means for enabling said apparatus to readily be broken down into upper and lower sub-assemblies to facilitate transporting said apparatus between a laboratory-like environment and a well-field environment; said gyroscopic directional instrument system including electric motor means for driving a gimbal arrangement and a first power supply for providing a principal source of electromotive force (EMF) for powering said electric motor means; said apparatus having inclinometer means and camera means and having a second power supply for providing a second source of electromotive force (EMF) for powering certain typical operations of said camera means; said electric motor means, said inclinometer means, and said camera means being compatibly interarranged to establish a first group of component members disposed within said upper sub-assembly; said first power supply including numerous individually cased battery cell members compatibly arranged to establish a second group of component members disposed within said lower sub-assembly; the outer circumference surface of said interface switch sub means, being interposed between said upper and lower sub-assemblies, constituting a medial portion of the outer surface of said apparatus resulting in said interface switch sub means being directly exposed to the extremely hot temperatures; said isolation means including interface switch sub heat insulation means for minimizing any heat transfer upwardly from said interface switch sub means to said first group of component members, and battery pack heat insulation means for minimizing any heat transfer downwardly from said interface switch sub means to said second group of component members, thus the temperature of said first and second groups of component members is not adversely affected by any rise in temperature of said interface switch sub means.

4. An improved well surveying apparatus comprising, in combination, a gyroscopic directional instrument system, and isolation means for maintaining at least for a reasonable period of time a suitable internal environment in which said gyroscopic directional instrument system may reliably function while being exposed exteriorly to an extremely hostile environment known to exist at the lower reaches of deep wells which extend several miles into the surface of the earth, said isolation means comprising heat shield means for protecting said gyroscopic directional system from the extremely hot temperatures inherently existing in said hostile environment, and interface switch sub means for enabling said apparatus to readily be broken down into upper and lower sub-assemblies to facilitate transporting said apparatus between a laboratory-like environment and a well-field environment; said heat shield means including an upper vacuum flask constituting a part of said upper sub-assembly for encompassing and heat shielding a first group of component members of said apparatus, and a lower vacuum flask constituting a part of said lower sub-assembly for encompassing and heat shielding a second group of component members of said apparatus, thus each of said sub-assemblies is independently shielded from the extremely hot temperatures; said gyroscopic directional instrument system including electric motor means for driving a gimbal arrangement and a first power supply for providing a principal source of electromotive force (EMF) for powering said electric motor means, said first power supply being disposed within said lower sub-assembly thus being encompassed by said lower vacuum flask; said first power supply including numerous individually cased battery cell members arranged in series thus establishing a long string of battery cell members having considerable weight, and said apparatus including load-transition means for precluding any inertia loads (attributable to the weight of the string of battery cell members) from acting adversely upon said lower vacuum flask; said load-transition means including battery tube means for containing the string of battery cell members, said battery tube means being disposed within said lower vacuum flask, said load-transition means including support means for supporting said battery tube means merely from the upper end thereof, thus said battery tube means totally depends from said support means and extends downwardly into said lower vacuum flask; said load-transition means including shock absorber means disposed at the closed bottom of said battery tube means with the lowermost one of said string of battery cell members being restingly supported by said shock absorber means; said lower vacuum flask being formed from a substance which readily conducts electricity; said battery tube means including (at least in part) means for providing electrical continuity between the lowermost one of said string of battery cell members and said lower vacuum flask, thus said vacuum flask may be utilized for providing, at least in part, an electric circuit for interconnecting said electric motor means and said first power supply; said battery tube means including an intermediate tubular member interposed between upper and lower sleeve-like members, both of said sleeve-like members being provided with internally threaded portions with said upper internally threaded sleeve-like member constituting, at least in part, said support means; the remote ends of said intermediate tubular member being fixedly attached respectively to said upper and lower sleeve-like members and having the internally threaded portions thereof outwardly directed, and said battery tube means also including contact plug means provided with an externally threaded portion for threadedly engaging said lower internally threaded sleeve-like member thus providing means for closing the bottom of said battery tube means, said shock absorber means including load-bearing compression spring means restingly supported by said contact plug means; thus the weight of said long string of battery cell members is initially carried by said load-bearing compression spring means, thence by said contact plug means; thus the weight of said long string of battery cell members is initially carried by said load-bearing compression spring means, thence by said contact plug means (which depends from said lower sleeve-like member), thence longitudinally upwardly along said intermediate tubular member where it is finally carried by said upper sleeve-like member which constitutes, at least in part, said support means.

5. The combination as set forth in claim 4 in which said circuit means includes a contact head member for engaging and thus establishing an electrical contact with the lowermost one of said battery cell members, said contact plug means includes inwardly and outwardly directed cup-like portions communicated one with the other by an aperture provided therethrough, said load-bearing compression spring means being disposed at least in part within said inwardly directed cup-like portion and engaging said contact head member for making an electrical circuit between said contact head member and said contact plug means, said lower vacuum flask having a somewhat fragile closed bottom which is incapable of assuming any of said inertia load, said contact plug means being disposed adjacent to said fragile closed bottom although having a definite spaced distance between the bottom of said lower vacuum flask and said contact plug means, said circuit means also includes electrical conductor non-load-bearing compression spring means disposed at least in part within said outwardly directed cup-like portion and which bears against both of said contact plug means and the fragile closed bottom of said lower vacuum flask, and fastener means having a portion extending through said aperture for attaching said load-bearing and electrical conductor non-load-bearing compression springs one with the other, thus the electrical continuity between the lowermost one of said string of battery cell members and said vacuum flask is provided.

6. An improved well surveying apparatus comprising, in combination, a gyroscopic directional instrument system, and isolation means for maintaining at least for a reasonable period of time a suitable internal environment in which said gyroscopic directional instrument system may reliably function while being exposed exteriorly to an extremely hostile environment known to exist at the lower reaches of deep wells which extend several miles into the surface of the earth, said isolation means comprising heat shield means for protecting said gyroscopic directional instrument system from the extremely hot temperatures inherently existing in said hostile environment, and interface switch sub means for enabling said apparatus to readily be broken down into upper and lower sub-assemblies to facilitate transporting said apparatus between a laboratory-like environment and a well-field environment; said gyroscopic directional instrument system including electric motor means for driving a gimbal arrangement and a first power supply for providing a principal source of electromotive force (EMF) for powering said electric motor means; said isolation means including heat sink means for absorbing, within limits, the heat being generated by said electric motor means as power from said first power supply is being dissipated in the process of maintaining optimum revolutions-per-minute (RPM) of said gimbal arrangement, said heat sink means including a first mass of metal disposed adjacent said electric motor means and a second mass of metal and said electric motor means for readily conducting heat from one to the other; said second mass of metal (constituting in part said heat sink means) being tubular shaped, said first and second masses of metal being compatible in size and shape to enable a portion of said tubular shaped heat sink means to be slip fitted over said first mass of metal; said heat sink means including quick disconnect fastener means for: (1) rigidly joining said first and second masses of metal together, and (2) for facilitating expediency in separating said first and second masses of metal one from the other.

* * * * *